US012765656B2

(12) United States Patent
Tun

(10) Patent No.: US 12,765,656 B2
(45) Date of Patent: Oct. 20, 2026

(54) HAIRDRYER

(71) Applicant: JIYONSON CO. LTD., Taipei (TW)

(72) Inventor: Yun-Long Tun, Taipei (TW)

(73) Assignee: JIYONSON CO. LTD., Taipei (TW)

( * ) Notice: Subject to any disclaimer, the term of this patent is extended or adjusted under 35 U.S.C. 154(b) by 603 days.

(21) Appl. No.: 18/211,194

(22) Filed: Jun. 16, 2023

(65) Prior Publication Data

US 2024/0415259 A1 Dec. 19, 2024

Related U.S. Application Data

(60) Provisional application No. 63/353,092, filed on Jun. 17, 2022.

(51) Int. Cl.
*A45D 20/12* (2006.01)

(52) U.S. Cl.
CPC ..... *A45D 20/12* (2013.01)

(58) Field of Classification Search
CPC ..... A45D 20/12; A45D 20/122
See application file for complete search history.

(56) References Cited

U.S. PATENT DOCUMENTS

| | | | | |
|---|---|---|---|---|
| 2017/0033287 | A1* | 2/2017 | Chida | H10K 59/131 |
| 2022/0400827 | A1 | 12/2022 | Yao et al. | |
| 2024/0057739 | A1* | 2/2024 | Kim | A45D 20/12 |

FOREIGN PATENT DOCUMENTS

| | | | | |
|---|---|---|---|---|
| CN | 102309121 | A | 1/2012 | |
| CN | 205040874 | U | 2/2016 | |
| CN | 106264285 | A * | 1/2017 | A45D 20/12 |
| CN | 109090795 | A | 12/2018 | |
| CN | 111345568 | A | 6/2020 | |
| CN | 113040496 | A | 6/2021 | |
| JP | 2014233508 | A | 12/2014 | |
| JP | 2020193729 | A | 12/2020 | |
| WO | 2004019721 | A2 | 3/2004 | |
| WO | 2015083632 | A1 | 6/2015 | |

(Continued)

OTHER PUBLICATIONS

Machine generated translation of KR-20190071878-A by Clarivate (Year: 2019).*

(Continued)

*Primary Examiner* — Ngoc T Nguyen
(74) *Attorney, Agent, or Firm* — ScienBiziP, P.C.

(57) ABSTRACT

The present invention provides a blower device, which includes a signal receiving module for receiving work signals from an external expansion device when it's connected to the blower device; a proximity sensing module for detecting an identification signal of the external expansion device; a hot and cold air generation module, coupled with the signal receiving module, provides output wind force. When the external expansion device is connected, the hot and cold air generation module adjusts the working temperature and air volume of the output wind force based on the work signals; a power module, connected with the proximity sensing module, determines whether to provide power required to drive the blower device based on the identification signal; and an expansion device power supply module, connected to the power module, provides power required to drive the external expansion device when it's connected to the blower device.

9 Claims, 10 Drawing Sheets

(56) References Cited

FOREIGN PATENT DOCUMENTS

| | | | | |
|---|---|---|---|---|
| WO | 2021129225 | A1 | 7/2021 | |
| WO | WO-2022146119 | A1 * | 7/2022 | ..... A45D 20/122 |

OTHER PUBLICATIONS

Machine generated translation of CN-116648164-A by Clarivate (Year: 2023).*
Machine generated translation of CN-102309122-A by Clarivate (Year: 2012).*
Machine generated translation of CN-206687367-U by Clarivate (Year: 2012).*
CN 106264285 A including machine generated English translation provided by Clarivate. (Year: 2017).*

* cited by examiner

10

HAIRDRYER

CROSS-REFERENCE TO RELATED APPLICATIONS

The present application claims the benefit of and priority to U.S. Provisional Patent Application Ser. No. 63/353,092, filed on Jun. 17, 2022, entitled "BLOWING APPARATUS WITH EXPANDABLE FUNCTIONS AND EXPANSION DEVICE THEREOF," the contents of which are hereby incorporated herein fully by reference into the present application for all purposes.

FIELD

The present disclosure generally relates to a hairdryer capable of being used in conjunction with an external expansion device, where the hairdryer may identify the type of the external expansion device to control temperature and airflow speed, so as to meet the application requirements of the external expansion device.

BACKGROUND

People often rely on various types of household appliances for assistance in their daily lives, with the hairdryer being a common example. Typically, a hairdryer may produce either cold or hot airflow during operation, primarily used for drying hair or for other situations requiring the application of cold or hot airflow. However, within limited space, there is a desire for multi-functionality, much like the vacuum cleaner in the market, which may be paired with multiple accessories, thus enabling consumers to address various needs within confined spaces simultaneously. Therefore, the hairdryer is no longer solely focused on the single purpose of drying hair. If the hairdryer could be equipped with additional accessories to offer more functionalities, it could fulfill a broader range of consumer demands.

SUMMARY

In view of the above, it is necessary to provide a hairdryer that may be used independently and, when combined with specifically designed external components, may cater to various usage scenarios desired by consumers.

According to the present disclosure, a hairdryer is provided. The hairdryer includes an operational signal receiving module configured to receive operational signals transmitted by an external expansion device when the external expansion device is connected to the hairdryer, a proximity sensing module configured to sense an identification signal of the external expansion device, a cold-hot air generation module coupled with the operational signal receiving module and configured to provide an output airflow, a power module coupled with the proximity sensing module and configured to determine whether to supply power required to operate the hairdryer based on the identification signal, and an expansion device power supply module coupled with the power module and configured to provide power required to operate the external expansion device when connected to the hairdryer. When the external expansion device is connected to the hairdryer, the cold-hot air generation module adjusts an operating temperature and airflow volume of the output airflow based on the operational signals.

According to an implementation of the present disclosure, the hairdryer includes an outer shell provided with a transparent protective shell, and a pattern layer is disposed between the transparent protective shell and the outer shell.

According to an implementation of the present disclosure, the outer shell includes a gripping portion provided with an operational interface for performing functional operations of the hairdryer.

According to an implementation of the present disclosure, the operational interface includes a power button, a timer button, an airflow adjustment button, and a temperature adjustment button.

According to an implementation of the present disclosure, the hairdryer further includes a display screen coupled with the operational interface for displaying operational information of the hairdryer.

According to an implementation of the present disclosure, the pattern layer is an electronic paper coupled with the power module.

According to an implementation of the present disclosure, the external expansion device includes a relative electrical connection module configured to couple with the expansion device power supply module when the external expansion device is connected to the hairdryer to provide power required to operate the external expansion device, a signal generation module configured to generate the operational signals when the external expansion device is powered on, and an identification unit configured to provide the identification signal when the external expansion device is powered on.

According to an implementation of the present disclosure, the signal generation module of the external expansion device is an infrared signal emitter, and the operational signal receiving module is an infrared reception module.

According to an implementation of the present disclosure, the proximity sensing module is a Hall sensor.

Through the aforementioned approach, the hairdryer may not only be utilized independently through its inherent functionalities but also be employed in conjunction with specially designed external components to meet users' requirements in various scenarios.

BRIEF DESCRIPTION OF THE DRAWINGS

To provide a clearer explanation of the implementations of the present application or the technical solutions in the prior art, the following brief introduction of the drawings required for the description of the implementations or the prior art is presented. It is evident that the drawings described below represent only some implementations of the present application. One with ordinary skill in the art may derive other drawings based on these drawings without exercising creative labor.

DETAILED DESCRIPTION

Figure 1:
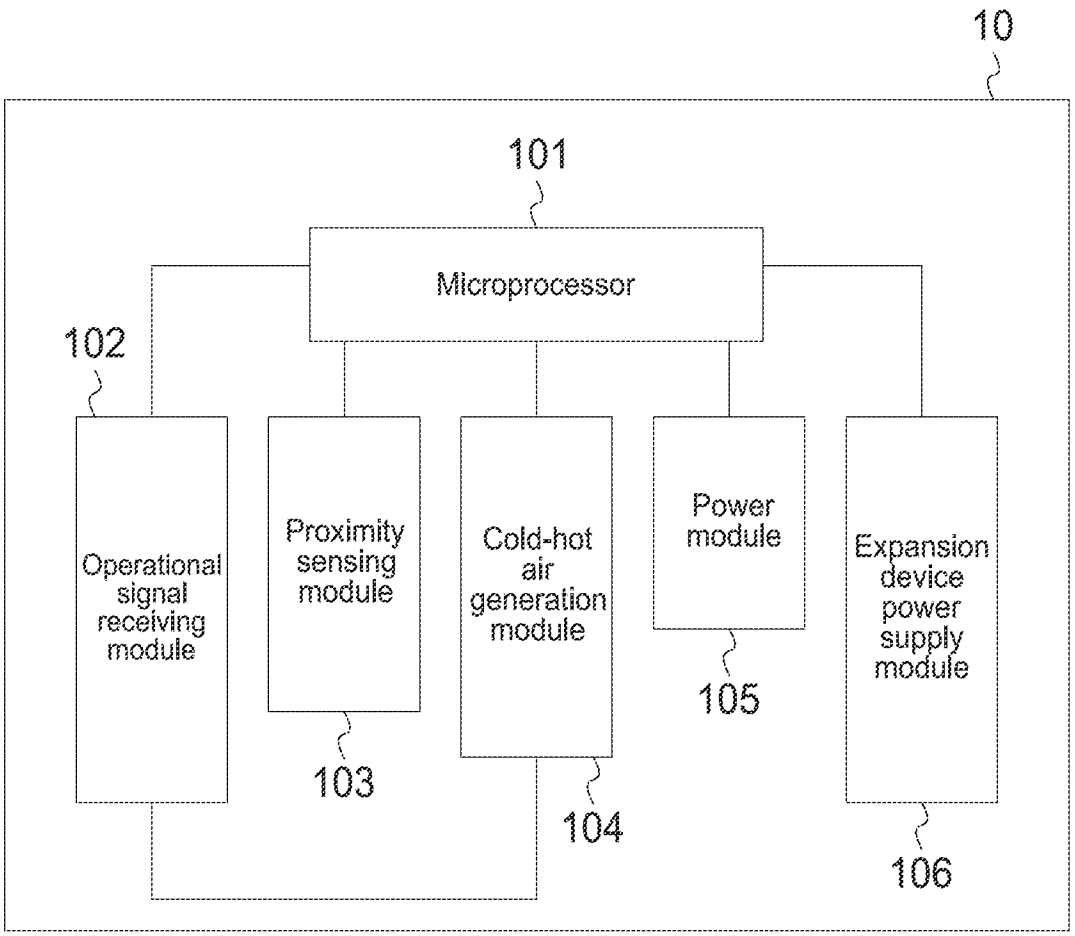
FIG. 1 shows a schematic diagram of electronic components within a hairdryer in accordance with an example implementation of the present disclosure.

The following description contains specific information related to exemplary implementations of the present disclosure. The drawings and their accompanying detailed descriptions provided herein are merely exemplary implementations. However, the present disclosure is not limited to these exemplary implementations. One with ordinary skill in the art will conceive of other variations and implementations of the present disclosure. Unless otherwise indicated, identical or corresponding components in the drawings may be indicated by the same or corresponding reference numerals. Additionally, the drawings and exemplary implementations in the present disclosure are typically not drawn to scale and are not intended to correspond to actual relative sizes.

For the sake of consistency and ease of understanding, the same features are denoted by reference signs in the exemplary drawings (though not labeled as such in some examples). However, the features in different implementations may differ in other respects, and thus may not be narrowly construed to be limited to the features shown in the drawings.

In terms such as "at least one implementation", "an implementation", "multiple implementations", "different implementations", "some implementations", "the implementation", and the like, it may refer to implementations of the present disclosure that include specific features, structures, or characteristics. However, not all possible implementations of the present disclosure need to include specific features, structures, or characteristics. Furthermore, the repeated phrases "in an implementation", "in the implementation" may not necessarily refer to the same implementation, even though they might be the same. Additionally, phrases like "implementation" when used in connection with "the present disclosure" do not imply that all implementations of the present disclosure must include specific features, structures, or characteristics, and should be understood as "at least some implementations of the present disclosure" including the specific features, structures, or characteristics mentioned. The term "coupled" is defined as being connected, whether directly, electrically, or indirectly through an intermediary element, and is not necessarily limited to physical connections. When the term "comprising" is used, it means "including but not limited to", indicating an open-ended inclusion or relationship of the described combination, group, series, and equivalents thereof.

Furthermore, for explanatory and non-limiting purposes, specific details such as functional entities, technologies, protocols, standards, and the like are expounded upon to provide an understanding of the technology described. In other instances, details of well-known methods, techniques, systems, architectures, and the like are omitted to avoid obscuring the description with unnecessary details.

The terms "first", "second", "third", and the like, used in the specification and the above drawings are used to distinguish different objects and are not used to describe a particular sequence. Additionally, the term "comprising" and its variations are intended to cover non-exclusive inclusion. For example, a process, method, system, product, or device that includes a series of steps or modules is not limited to the listed steps or modules but optionally includes steps or modules not listed, or optionally includes other inherent steps or modules inherent to these processes, methods, products, or devices.

The present disclosure will be described in further detail below in conjunction with the accompanying drawings.

Refer to FIG. 1, which shows a schematic diagram of electronic components within a hairdryer in accordance with an example implementation of the present disclosure. As shown in the figure, the hairdryer 10 of the present disclosure may be connected to an external expansion device and may fulfill users' needs in different situations through the external expansion device. The external expansion device may take any form and may be assembled with the hairdryer 10 as an external component. The type and form of the external expansion device are not limited to the examples provided herein. The hairdryer 10 disclosed in the present disclosure may possess the functions of a conventional hairdryer. The hairdryer 10 may include a handle, a rear air inlet, a front air outlet, and an operational interface. The operational interface may include modes for switching functions of typical temperature and airflow speed. The hairdryer 10 may contain components such as heating coils and fans, and users may switch between different combinations of airflow speed and temperature settings in several predefined mode switches. In addition to including all or part of the functions of a conventional hairdryer, the hairdryer may automatically adjust parameters of the internal fan and heater based on the functionalities of the external expansion device, thus making the hairdryer expandable.

The hairdryer 10 includes a microprocessor 101, an operational signal receiving module 102, a proximity sensing module 103, a cold-hot air generation module 104, a power module 105, and an expansion device power supply module 106. The microprocessor 101 may provide functions such as performing logical operations, storing temporary operation results, saving instruction execution locations, and the like. The microprocessor 101 may be a central processing unit (CPU), a virtual CPU (vCPU), a microprocessor (MPU), a microcontroller (MCU), an application processor (AP), an embedded processor, an application-specific integrated circuit (ASIC), a tensor processing unit (TPU), a graphics processing unit (GPU), and the like, but is not limited to the examples provided herein. The microprocessor 101 is coupled with the various modules mentioned above, thus enabling communication between these modules and driving them to perform operations based on the instructions stored internally. The operational signal receiving module 102 is used to receive operational signals transmitted by the external expansion device when connected to the hairdryer 10. The proximity sensing module 103 is used to sense an identification signal of the external expansion device. The cold-hot air generation module 104 is coupled with the operational signal receiving module 102 and provides an output airflow. The cold-hot air generation module 104 may adjust the operating temperature and airflow volume of the output airflow based on the operational signals. Specifically, the cold-hot air generation module 104 contains components such as heating coils and fans. The fans blow out the heat generated by the heating coils, or the fans alone may blow cold air. The cold-hot air generation module 104 may control fan speed according to control signals generated by the microprocessor 101. In some implementations, settings of the fan speed may include acceleration, constant (maintain the original speed), deceleration, and mode variations over time based on specific needs. The heating coils may control heating efficiency according to control signals generated by the microprocessor 101, thereby adjusting the temperature. In some implementations, settings of the temperature may include warming, constant temperature, cooling, and variations over time. The power module 105 is coupled with the proximity sensing module 103 and provides the power needed to drive the hairdryer 10. The power module 105 may be a power control circuit used in general electrical appliances, including components that may accept typical AC power sources or use DC power sources from batteries. The expansion device power supply module 106 provides power for the operation of the external expansion device.

Figure 2:
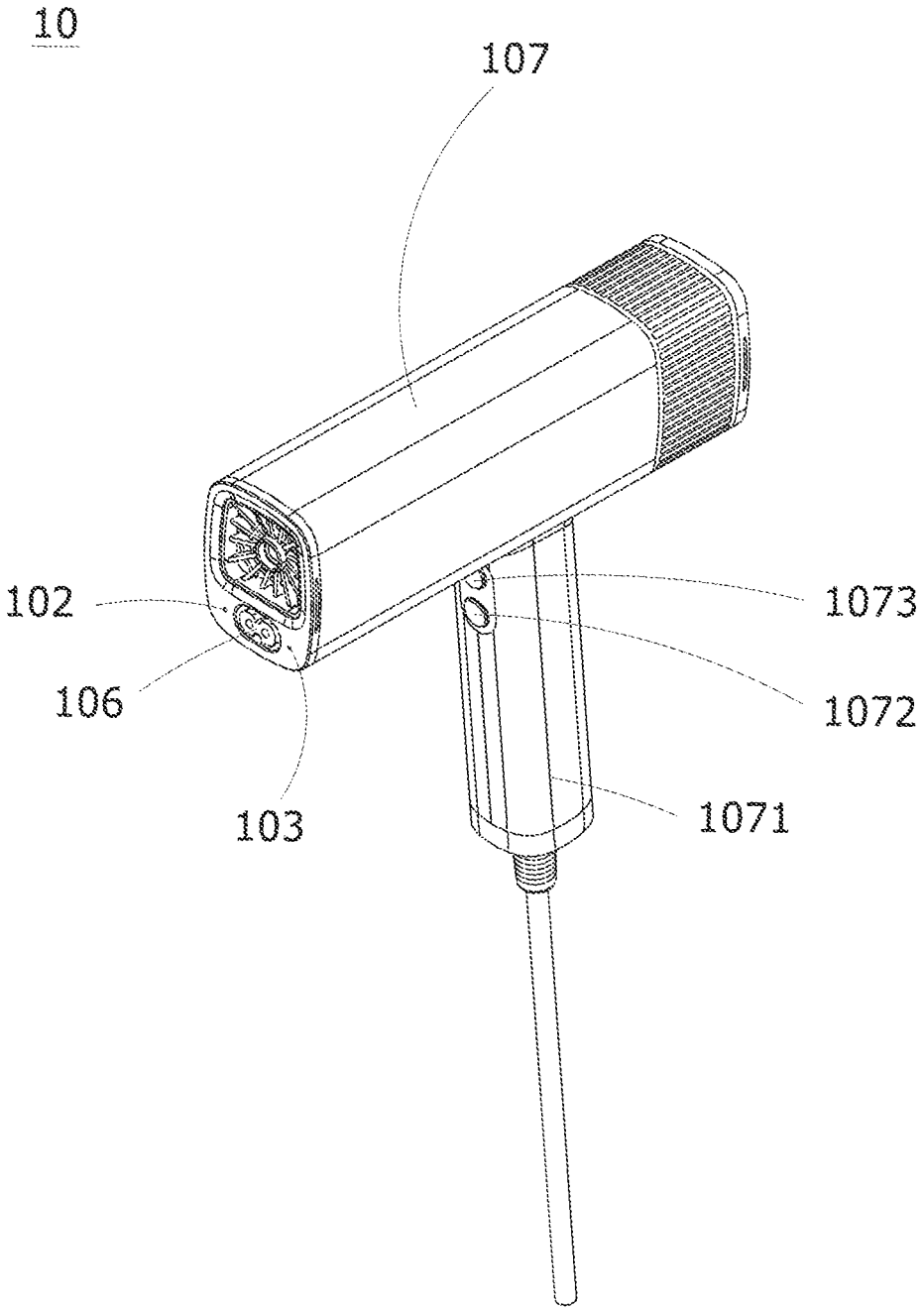
FIG. 2 shows a schematic diagram of the hairdryer in accordance with an example implementation of the present disclosure.

Referring to FIG. 2, which shows a schematic diagram of the hairdryer in accordance with an example implementation of the present disclosure, in view of FIG. 1, the operational signal receiving module 102, the proximity sensing module 103, and the expansion device power supply module 106 are positioned beneath the air outlet of the hairdryer 10. In some implementations, the operational signal receiving module 102, the proximity sensing module 103, and the expansion device power supply module 106 may be located adjacent to the air outlet of the hairdryer 10 (for example, above, to the right, and to the left of the air outlet). This arrangement facilitates the transmission of signals or power between the external expansion device and the operational signal receiving module 102, the proximity sensing module 103, and the expansion device power supply module 106 when the external expansion device is connected to the hairdryer. Specifically, the operational signal receiving module 102 and the proximity sensing module 103 are positioned on either side of the expansion device power supply module 106 to detect and receive the provided external signals. The expansion device power supply module 106 may be in the form of a power plug for electrical connection with the external expansion device. The hairdryer 10 having an outer shell 107 may include a gripping portion 1071 with an operational interface. The operational interface primarily includes multiple physical operation buttons that may include an airflow adjustment button 1072 and a temperature adjustment button 1073. The airflow adjustment button 1072 and the temperature adjustment button 1073 are coupled with the cold-hot air generation module 104. The airflow adjustment button 1072 mainly controls the fan speed of the cold-hot air generation module 104, thus adjusting the airflow volume of the output airflow of the hairdryer 10. The temperature adjustment button 1073 mainly controls the heating coils of the cold-hot air generation module 104 to adjust both the temperature of the heat generated by the heating coils and the operating temperature of the output airflow, so that the hairdryer 10 may blow airflow with appropriate temperature according to user requirements.

Figure 3:
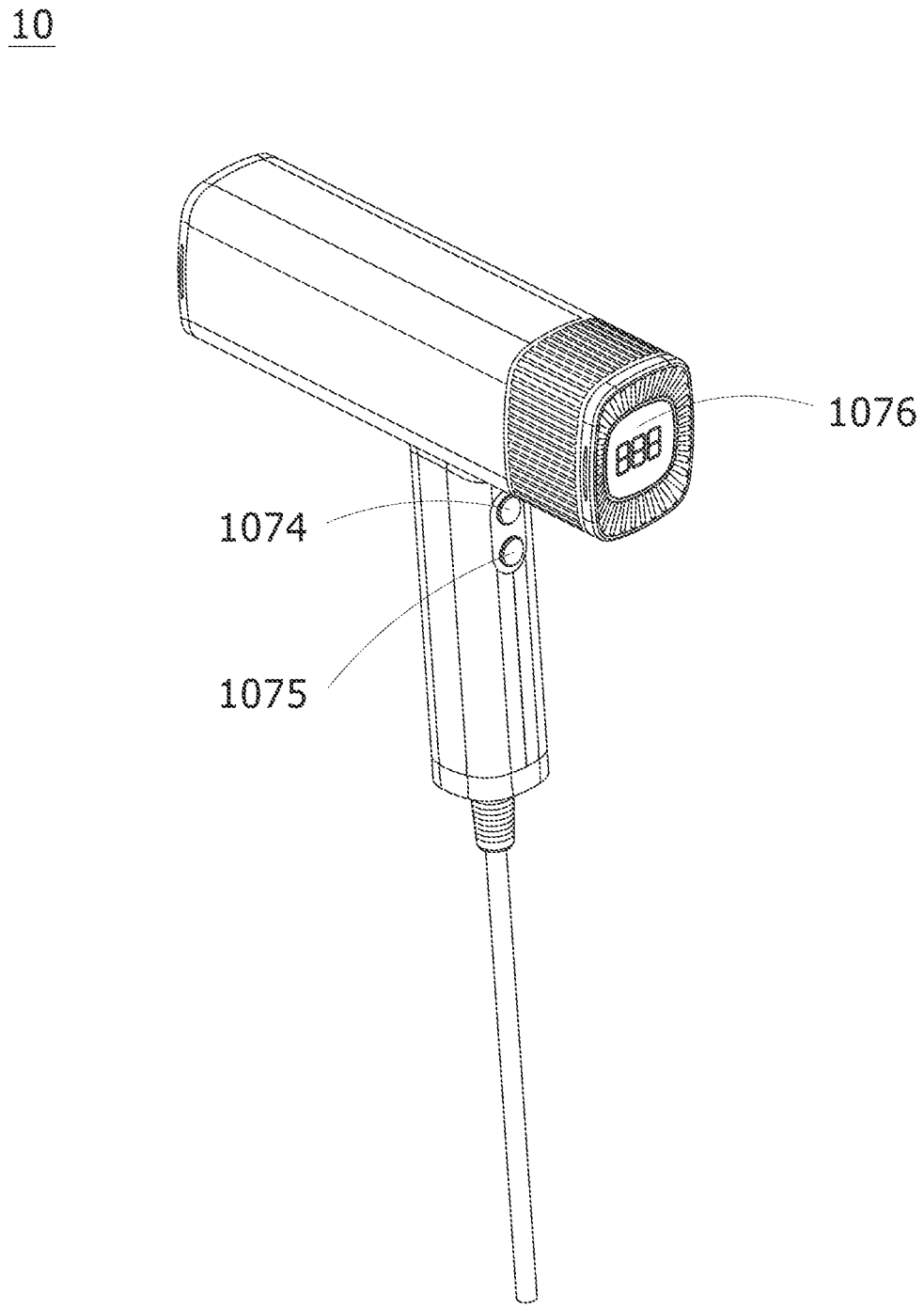
FIG. 3 shows another schematic diagram of the hairdryer in accordance with an example implementation of the present disclosure.

Referring to FIG. 3, which shows another schematic diagram of the hairdryer in accordance with an example implementation of the present disclosure, in view of FIG. 1, the operational interface of the hairdryer 10 further includes a power button 1074 and a timer button 1075. The power button 1074 and the timer button 1075 are coupled with the power module 105. The power button 1074 may serve as a simple power switch. The power module 105 may control the power supply of the hairdryer 10 to be turned on or off by turning on or off the power button 1074. The timer button 1075 may be used to set a specific time (e.g., 10 minutes or 1 hour) after which the power module 105 disconnects power supply to the hairdryer 10, thus controlling the operational time of the hairdryer 10. In some implementations, as shown in this figure, the hairdryer 10 is equipped with a display screen 1076. The display screen 1076 may be an LED, an LCD display, or the like. The display screen 1076 may be coupled with the microprocessor 101 inside the hairdryer 10 and the operational interface, allowing the display screen 1076 to obtain and display operational information about the hairdryer 10. The display screen 1076 may further display corresponding information based on signals generated by the microprocessor 101 regarding operation of the hairdryer 10, such as power indicators, temperature values, airflow speeds, set timer indications, or operational modes and functions of connected external expansion devices.

Figure 4:
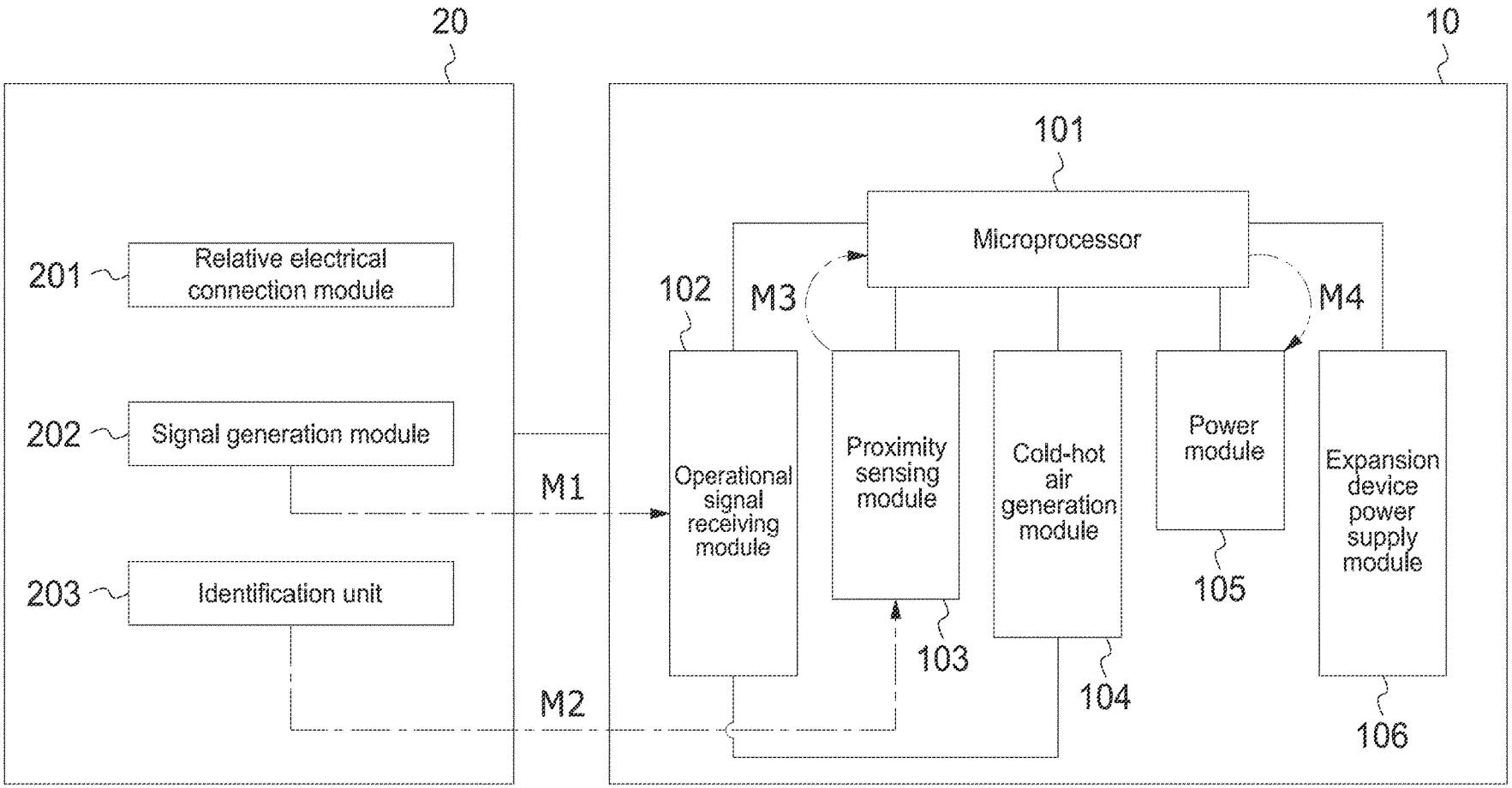
FIG. 4 shows a schematic diagram of operations of the hairdryer when connected with an external expansion device in accordance with an example implementation of the present disclosure.

Refer to FIG. 4, which shows a schematic diagram of operations of the hairdryer when connected with an external expansion device in accordance with an example implementation of the present disclosure. As shown in the figure, the external expansion device 20 includes a relative electrical connection module 201, a signal generation module 202, and an identification unit 203. When the hairdryer 10 is connected to the external expansion device 20, the expansion device power supply module 106 is coupled with the relative electrical connection module 201 to provide power required for driving the external expansion device 20. After the external expansion device 20 receives power, the signal generation module 202 generates an operational signal M1. After the operational signal M1 is provided to the microprocessor 101 through the operational signal receiving module 102 for identification, the microprocessor 101 then provides the control signal to control the cold-hot air generation module 104 to adjust the operating temperature and airflow volume of the output airflow based on the operational signal M1. In some implementations, the signal generation module 202 of the external expansion device 20 is an infrared signal emitter, and the operational signal receiving module 102 of the hairdryer 10 is an infrared reception module. When the relative electrical connection module 201 of the external expansion device 20 is coupled with the expansion device power supply module 106 of the hairdryer 10, the signal generation module 202 of the external expansion device 20 emits an infrared signal. The infrared signal may be the operational signal M1. The operational signal M1 may contain model information (e.g., device types) of the external expansion device 20, or the operational conditions required for the external expansion device 20, including operating temperature, airflow volume, and blowing time. After the operational signal receiving module 102 of the hairdryer 10 receives the operational signal M1 and the microprocessor 101 recognizes the operational signal M1, a control signal is further generated to control the cold-hot air generation module 104 to generate corresponding operational modes based on the operational signal M1.

The proximity sensing module 103 may detect an identification signal M2 generated by the identification unit 203, allowing the power module 105 to select one of the states of conduction or interruption of power supply to the external expansion device 20 based on the identification signal M2. In some implementations, the proximity sensing module 103 may be a Hall sensor capable of switching states based on detected magnetic fields. The identification unit 203 may, for example, be a magnet or a device capable of generating a magnetic field. When the hairdryer 10 is connected to the external expansion device 20, the proximity sensing module 103 continuously detects the identification signal M2 emitted by the identification unit 203 of the external expansion device 20. Continuous detection of the identification signal M2 by the proximity sensing module 103 indicates that the hairdryer 10 and the external expansion device 20 are still properly connected and in a normal operating state. If the proximity sensing module 103 fails to detect the identification signal M2 generated by the identification unit 203, the hairdryer 10 and the external expansion device 20 may be separated due to problems such as loose buckling structure. At this time, if the hairdryer 10 continues to be in operating state, it could potentially damage either the hairdryer 10 or the external expansion device 20. Therefore, when the proximity sensing module 103 fails to detect the identification signal M2 generated by the identification unit 203, the proximity sensing module 103 generates an information interruption signal M3. The information interruption signal M3 indicates that the hairdryer 10 has been disconnected from the external expansion device 20 or that the connection between these two components is incomplete. The proximity sensing module 103 sends the information interruption signal M3 to the microprocessor 101 for identification. Once the microprocessor 101 identifies and confirms the information interruption signal M3, the microprocessor 101 generates a power interruption signal M4. The power interruption signal M4 is then sent to the power module 105, causing the power module 105 to initiate a power interruption process based on the power interruption signal M4. This process ensures that the hairdryer 10 stops operating when not properly connected to the external expansion device 20 to prevent potential damage to either the hairdryer 10 or the external expansion device 20, or even unintended harm to the user.

Figure 5:
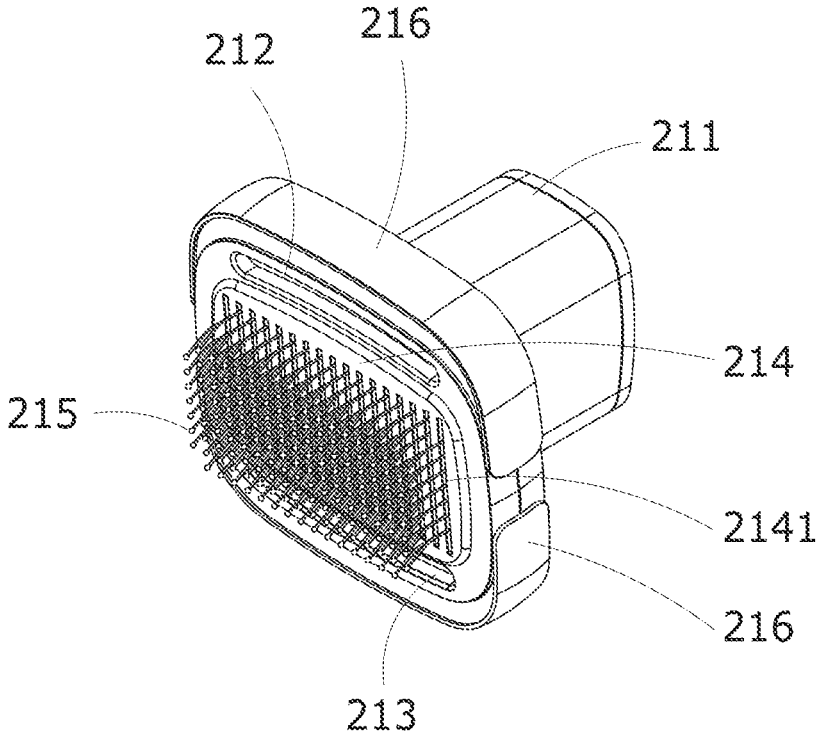
FIG. 5 shows a schematic diagram of an external expansion device in accordance with an example implementation of the present disclosure.

Refer to FIG. 5, which shows a schematic diagram of an external expansion device in accordance with an example implementation of the present disclosure. As shown in the figure, a pet hair combing device 21 is an additional fitting that may be matched with the hairdryer 10. In other words, the pet hair combing device 21 is one type of the external expansion devices for the hairdryer 10, and the pet hair combing device 21 basically includes the components of the above-mentioned external expansion device. The pet hair combing device 21 includes an assembly head body 211, and a first air outlet 212 and a second air outlet 213 are disposed at one end of the assembly head body 211. A pushing piece 214 is movably disposed between these two air outlets (212, 213), and several holes 2141 are formed on the pushing piece 214. The holes 2141 may allow several bristle brushes 215 of the assembly head body 211 to pass through. Pushing buttons 216 may be disposed on opposite sides of the assembly head body 211. When the pushing buttons 216 are pressed, the pushing piece 214 are driven to move back and forth relative to the bristle brushes 215.

Figure 6:
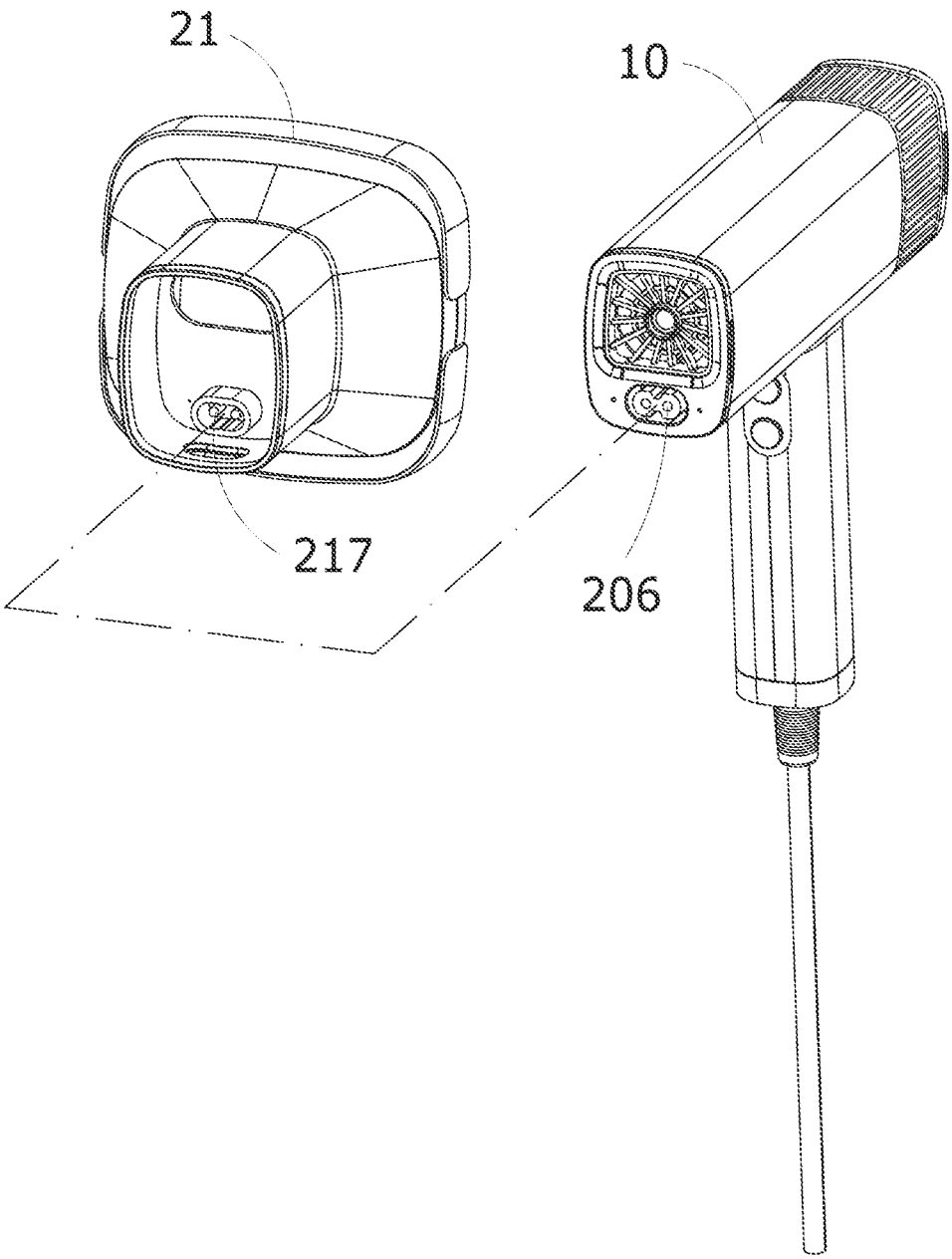
FIG. 6 shows a schematic diagram of an external expansion device assembled to the hairdryer in accordance with an example implementation of the present disclosure.
Figure 7:
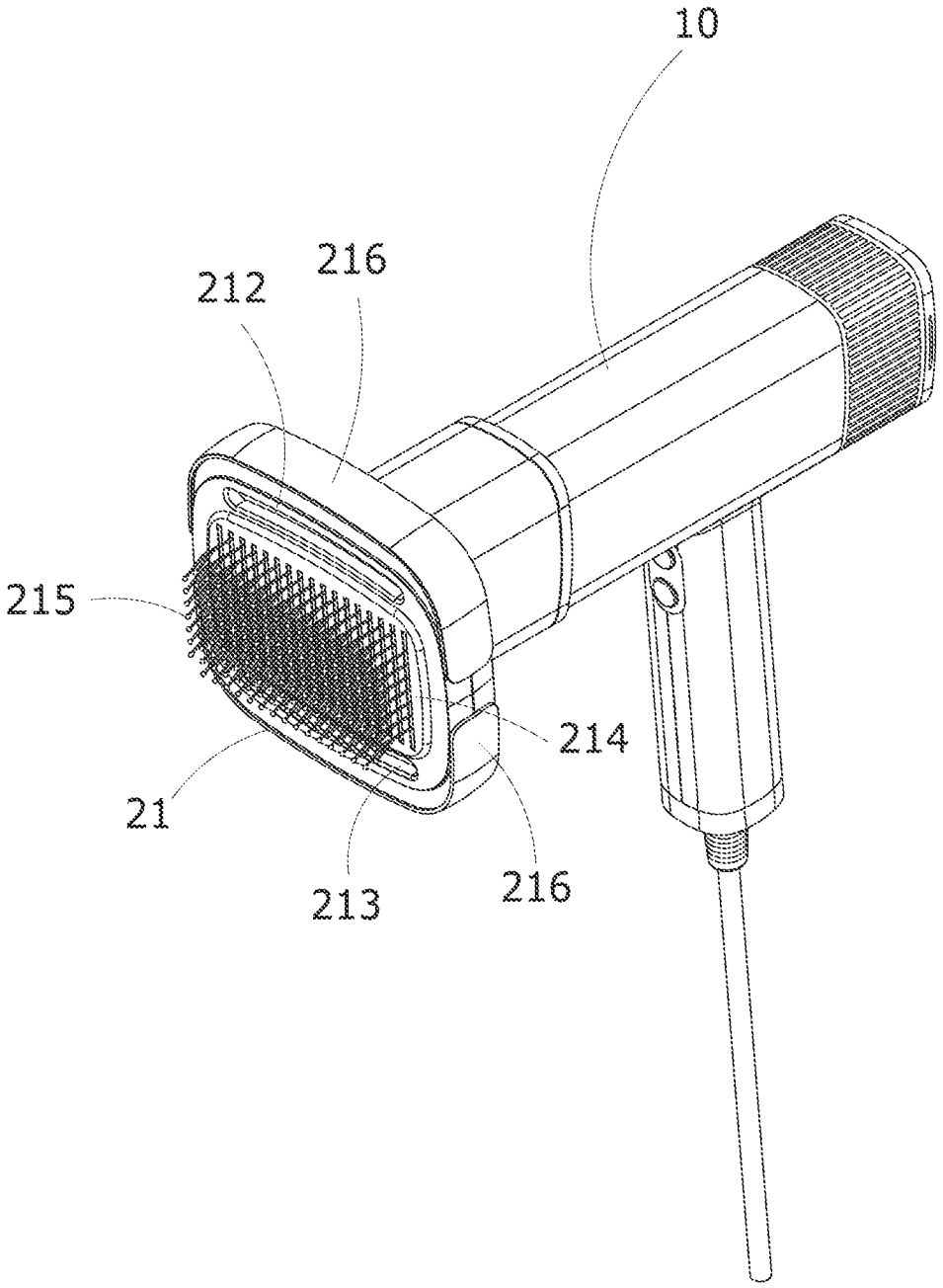
FIG. 7 shows another schematic diagram of the external expansion device assembled to the hairdryer in accordance with an example implementation of the present disclosure.

Refer to FIG. 6, which shows a schematic diagram of an external expansion device assembled to the hairdryer in accordance with an example implementation of the present disclosure. Based on the description in FIG. 5, the other side of the assembly head body 211 is equipped with a relative electrical connection module 217. The relative electrical connection module 217 may be coupled with the expansion device power supply module 106 of the hairdryer 10, and when the assembly head body 211 is connected to the hairdryer 10, the coupling between the expansion device power supply module 106 and the relative electrical connection module 217 further strengthens the connection between the pet hair combing device 21 and the hairdryer 10, thus making pet hair combing device 21 to be less likely separated from the hairdryer 10. The assembled state of the pet hair combing device 21 and the hairdryer 10 is shown in FIG. 7, which shows another schematic diagram of the external expansion device assembled to the hairdryer in accordance with an example implementation of the present disclosure. As shown in FIG. 7, generally, when the hairdryer 10 is activated, the airflow blown out may pass through the first air outlet 212 and the second air outlet 213 of the pet hair combing device 21. Users may comb their pets' hair using the bristle brushes 215 and control the hairdryer 10 to blow hot or cold air through these two air outlets (212, 213), thus achieving the dual purpose of combing and blowing. The combination operation of the pet hair combing device 21 and the hairdryer 10 may effectively prevent the occurrence of mold or eczema on the pet's skin surface. After completing the pet's hair combing, users may press the pushing button 216 to move the pushing piece 214 relative to the bristle brushes 215, pushing out the pet hair that are stuck on the bristle brushes 215 by the pushing piece 214 for easy cleaning and tidying.

Figure 8:
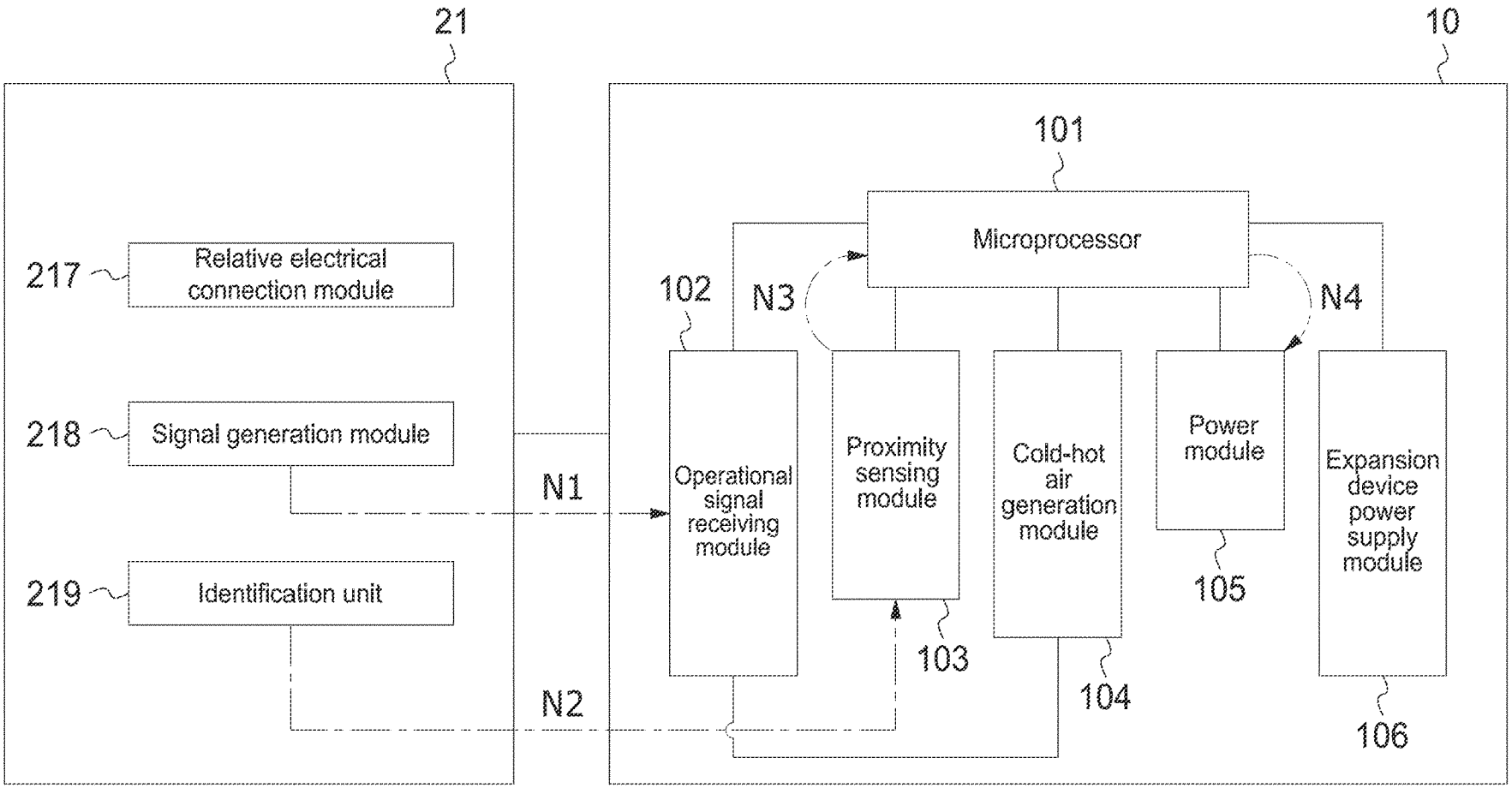
FIG. 8 shows a schematic diagram of operations of the hairdryer when connected with a pet hair combing device in accordance with an example implementation of the present disclosure.

Refer to FIG. 8, which shows a schematic diagram of operations of the hairdryer when connected with a pet hair combing device in accordance with an example implementation of the present disclosure. As shown in the figure, the pet hair combing device 21 includes a relative electrical connection module 217, a signal generation module 218, and an identification unit 219. When the hairdryer 10 is connected to the pet hair combing device 21, the expansion device power supply module 106 is coupled with the relative electrical connection module 217 to provide power required for driving the pet hair combing device 21. After the pet hair combing device 21 receives power, the signal generation module 218 generates an operational signal N1. After the operational signal N1 is provided to the microprocessor 101 through the operational signal receiving module 102 for identification, the microprocessor 101 then provides a control signal to control the cold-hot air generation module 104 to adjust the operating temperature and airflow volume of the output airflow based on the operational signal N1. In some implementations, when the relative electrical connection module 217 of the pet hair combing device 21 is coupled with the expansion device power supply module 106 of the hairdryer 10, the signal generation module 218 of the pet hair combing device 21 generates the operational signal M1. The operational signal M1 contains operational information for the pet hair combing device 21, such as the operational conditions required for the pet hair combing device 21, including blowing temperature, airflow speed, and blowing time. After the operational signal receiving module 102 of the hairdryer 10 receives the operational signal N1 and the microprocessor 101 recognizes the operational signal N1, the control signal is further generated to control the cold-hot air generation module 104 to generate operational modes corresponding to the pet hair combing device 21 based on the operational signal N1.

As mentioned above, the proximity sensing module 103 may detect an identification signal N2 generated by the identification unit 219, thus allowing the power module 105 to select one of the states of conduction or interruption of power supply to the pet hair combing device 21 based on the identification signal N2. In some implementations, when the hairdryer 10 is connected to the pet hair combing device 21, the proximity sensing module 103 continuously detects the identification signal N2 emitted by the identification unit 219 of the pet hair combing device 21. Continuous detection of the identification signal N2 by the proximity sensing module 103 indicates that the hairdryer 10 and the pet hair combing device 21 are still properly connected. If the proximity sensing module 103 fails to detect the identification signal N2 generated by the identification unit 219, the hairdryer 10 and the pet hair combing device 21 may be separated due to problems such as loose buckling structure. At this time, if the hairdryer 10 continues to be in operating state, it could potentially damage either the hairdryer 10 or the pet hair combing device 21. Therefore, when the proximity sensing module 103 fails to detect the identification signal N2 generated by the identification unit 219, the proximity sensing module 103 generates an information interruption signal N3. The information interruption signal N3 indicates that the hairdryer 10 has been disconnected from the pet hair combing device 21 or that the connection between these two components is incomplete. The proximity sensing module 103 sends the information interruption signal N3 to the microprocessor 101 for identification. Once the microprocessor 101 identifies and confirms the information interruption signal N3, the microprocessor 101 generates a power interruption signal N4. The power interruption signal N4 is then sent to the power module 105, thus causing the power module 105 to initiate a power interruption process based on the power interruption signal N4. This process ensures that the hairdryer 10 stops operating when not properly connected to the pet hair combing device 21 to prevent potential damage to either the hairdryer 10 or the pet hair combing device 21, or even unintended harm to the user or pets.

Figure 9:
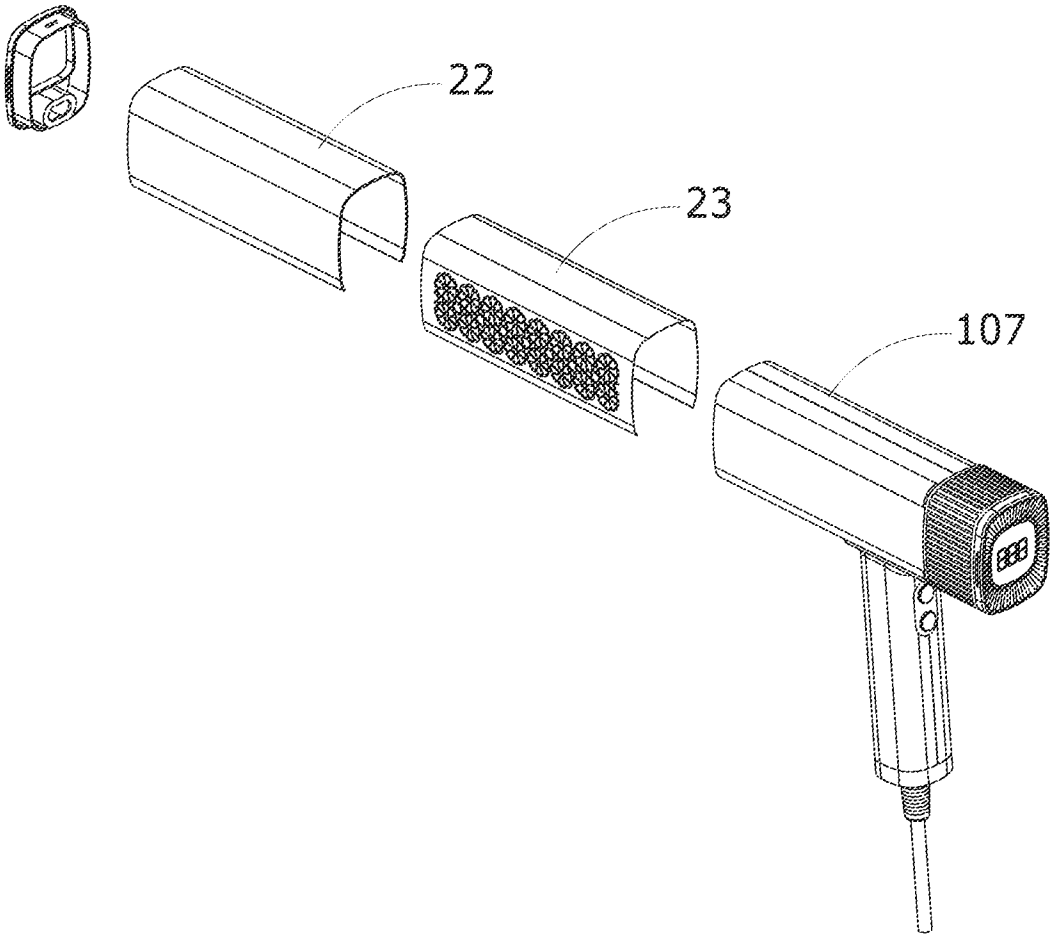
FIG. 9 shows another implementation of a hairdryer in accordance with the present disclosure.

Refer to FIG. 9, which shows another implementation of a hairdryer in accordance with the present disclosure. In the implementation, the outer shell 107 is equipped with a transparent protective shell 22, and a pattern layer 23 is disposed between the transparent protective shell 22 and the outer shell 107. The pattern layer 23 may be a surface-printed advertisement paper with advertisements, patterns, colors, or text, but may also be other forms of items, without specific limitations. The pattern layer 23 is mainly adhered to the exterior of the outer shell 107 and is protected by the transparent protective shell 22 to prevent damage from external forces.

Figure 10:
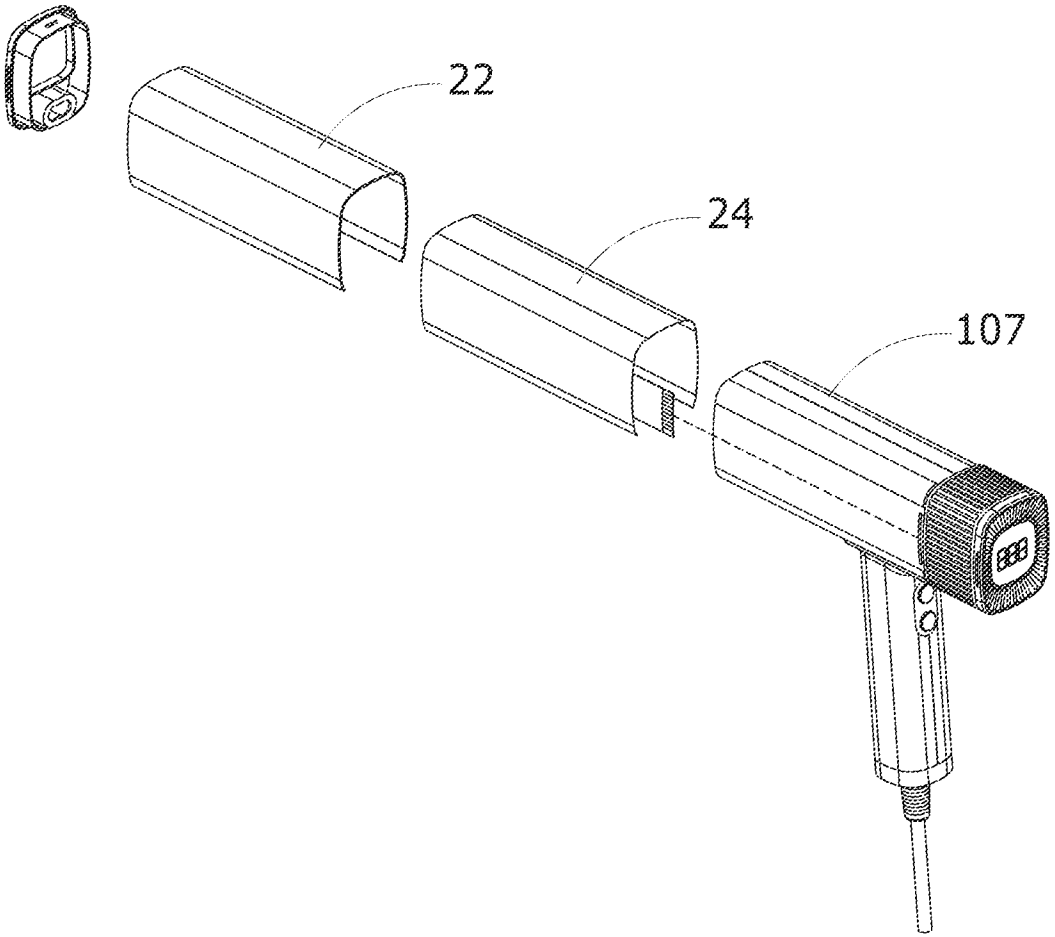
FIG. 10 shows another implementation of a hairdryer in accordance with the present disclosure.

Referring to FIG. 10, which shows another implementation of a hairdryer in accordance with the present disclosure, and in view of FIG. 1, in some implementations, the pattern layer may be an electronic paper 24. The electronic paper 24 may be adhered to a suitable position on the surface of the outer shell 107 and be protected by the transparent protective shell 22 on the exterior of the outer shell 107. The power module 105 of the hairdryer 10 is coupled with the electronic paper 24 and provides power to drive the electronic paper. The electronic paper 24 may display a variety of patterns through pre-loaded animations or designs. This offers diversified pattern presentations through the electronic paper 24.

Based on the descriptions above, it is evident that various techniques may be employed to implement the concepts described in this application, without departing from the scope of these concepts. Furthermore, while specific implementations have been referenced and described, one with ordinary skill in the art will recognize that variations may be made in form and detail without departing from the scope of these concepts. Thus, the described implementations are to be considered illustrative and not restrictive in all aspects. Moreover, it should be understood that this application is not limited to the specific implementations mentioned above, but rather encompasses many rearrangements, modifications, and substitutions within the scope of the present disclosure.

What is claimed is:

1. A hairdryer, comprising:

an infrared signal receiver configured to receive operational signals transmitted by an external expansion device when the external expansion device is connected to the hairdryer;

a proximity sensing module configured to sense an identification signal of the external expansion device;

a cold-hot air generation module coupled to the infrared signal receiver, and configured to provide an output airflow, wherein, when the external expansion device is connected to the hairdryer, the cold-hot air generation module adjusts an operating temperature and an airflow volume of the output airflow based on the operational signals;

a power module coupled to the proximity sensing module, and configured to determine whether to supply power required to operate the hairdryer based on the identification signal; and an expansion device power supply module coupled to the power module, and configured to provide power required to operate the external expansion device when the external expansion device is connected to the hairdryer.

2. The hairdryer of claim 1, wherein the hairdryer further comprises;

an outer shell provided with a transparent protective shell, and a pattern layer is disposed between the transparent protective shell and the outer shell.

3. The hairdryer of claim 2, wherein the outer shell comprises a gripping portion provided with an operational interface for performing functional operations of the hairdryer.

4. The hairdryer of claim 3, wherein the operational interface comprises a power button, a timer button, an airflow adjustment button, and a temperature adjustment button.

5. The hairdryer of claim 3, wherein the hairdryer further comprises;

a display screen coupled with the operational interface for displaying operational information of the hairdryer.

6. The hairdryer of claim 2, wherein the pattern layer is an electronic paper coupled to the power module.

7. The hairdryer of claim 1, wherein the external expansion device comprises:

an electrical connector configured to couple to the expansion device power supply module when the external expansion device is connected to the hairdryer to provide the power required to operate the external expansion device;

a signal generation module configured to generate the operational signals when the external expansion device is powered on; and an identification unit configured to provide the identification signal when the external expansion device is powered on.

8. The hairdryer of claim 7, wherein the signal generation module of the external expansion device is an infrared signal emitter, and the infrared signal receiver is an infrared reception module.

9. The hairdryer of claim 1, wherein the proximity sensing module is a Hall sensor.

* * * * *